United States Patent [19]

Greenspan

[11] 4,138,745

[45] Feb. 13, 1979

[54] PUPPET FOR CLOTHING POCKET

[76] Inventor: Alice H. Greenspan, 539 Avenida del Norte, Sarasota, Fla. 33581

[21] Appl. No.: 833,812

[22] Filed: Sep. 15, 1977

[51] Int. Cl.[2] ..... A41D 27/20; A63H 3/14

[52] U.S. Cl. ..... 2/247; 46/154; 46/126

[58] Field of Search ..... 2/247, 249, 252, 75; 46/154, 116

[56] References Cited

U.S. PATENT DOCUMENTS

| | | | |
|---|---|---|---|
| 1,417,860 | 5/1922 | Reich | 46/154 |
| 2,840,825 | 7/1958 | Gerrido | 2/252 |
| 3,308,479 | 3/1967 | Sesco, Jr. | 46/154 UX |
| 3,447,165 | 6/1969 | Brosk | 46/154 |
| 3,789,546 | 2/1974 | Morrison | 46/154 X |

*Primary Examiner*—Werner H. Schroeder
*Assistant Examiner*—Moshe I. Cohen
*Attorney, Agent, or Firm*—Clarence A. O'Brien; Harvey B. Jacobson

[57] ABSTRACT

A garment is provided including a front panel and a puppet toy comprising an elongated tubular puppet body constructed of flexible material and including three inwardly opening hollow fingerstall portions at one closed end portion of the body. The three inwardly opening fingerstall portions define a central hollow head portion and hollow outside arm portions. The second end portion of the body defines an entrance opening therein for the reception of a hand into the tubular body from the second end portion thereof and the second end portion of the body is anchored to the front panel of the garment. In a first form of the invention, the second end portion of the body is secured about a pocket opening formed in the garment front panel and the body of the puppet is receivable, in inside-out condition, within the pocket opening to define a pocket for the garment. In a second form of the invention, the front panel of the garment has a pocket patch secured thereover and the second end of the tubular puppet body is secured to the inner surface of the upper marginal edge of the pocket patch with the tubular puppet body being foldable and receivable within the pocket defined by the pocket patch. A third form of the invention is similar to the second form, but the second end of the tubular puppet body is secured to the outer surface of the front panel of the garment overlapped by the upper marginal edge of the pocket patch and the garment includes a pocket flap secured to the outer side thereof and overlapping the upper marginal edge of the pocket patch.

3 Claims, 8 Drawing Figures

Fig. 4
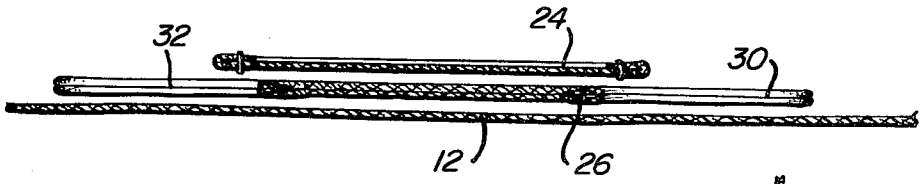
Fig. 5
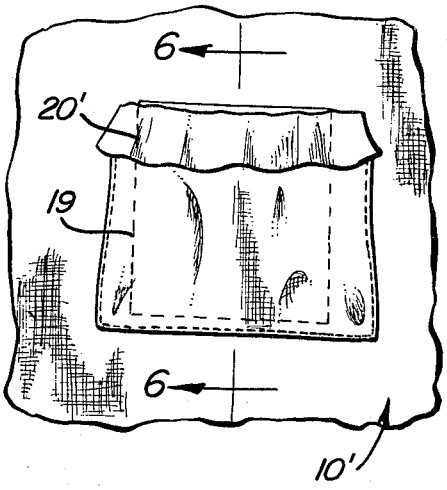
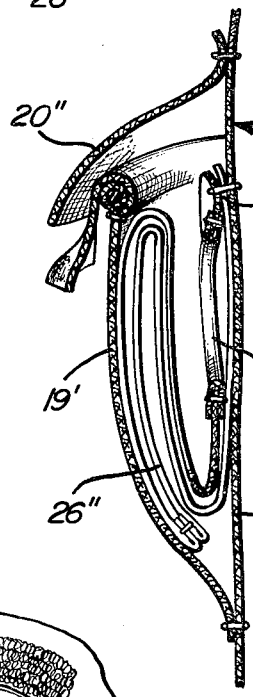
Fig. 7
Fig. 6
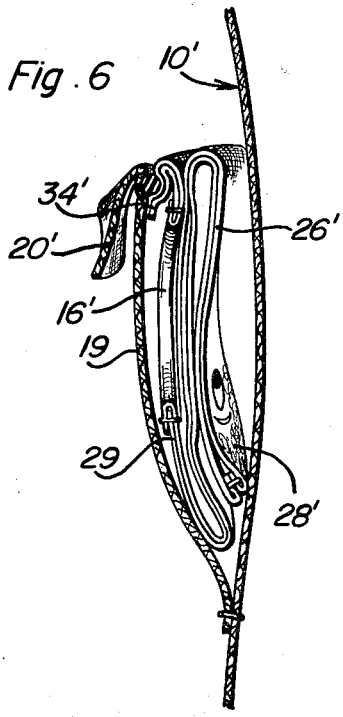
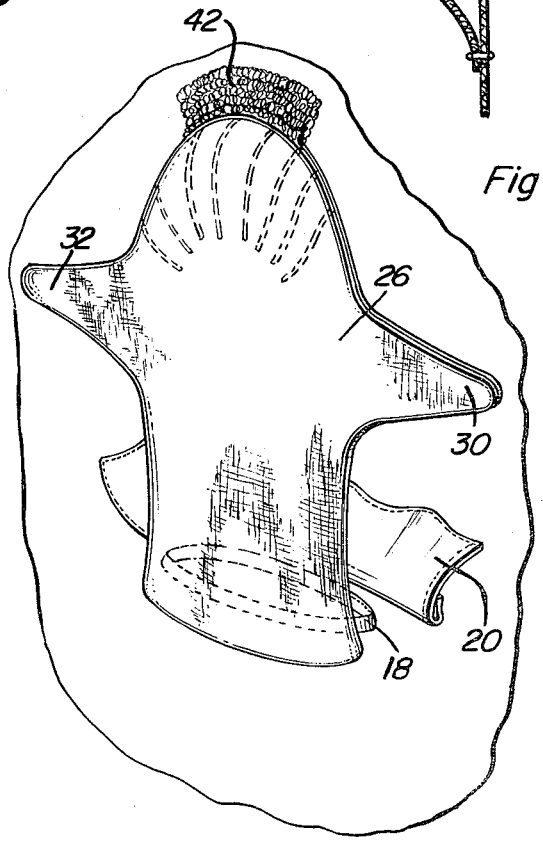
Fig. 8

PUPPET FOR CLOTHING POCKET

BACKGROUND OF THE INVENTION

Various forms of hand puppets have been heretofore provided and some have been provided in conjunction with clothing which may be worn by small children. However, there has been little development in the provision of hand puppets constructed as a portion of a garment worn over the torso of a small child or adult. Accordingly, there is a need for structure whereby a hand puppet may be provided on clothing of the type worn over the torso whereby small children may be amused by an adult wearing the garment or may entertain themselves or display their imagination to others.

Various forms of puppets of the hand type for use by children are disclosed in U.S. Pat. Nos. 1,417,860, 2,546,209, 3,447,165 and 3,789,545.

BRIEF DESCRIPTION OF THE INVENTION

The puppet toy of the instant invention includes an elongated tubular puppet body constructed of flexible material and including three inwardly opening hollow fingerstall portions at one closed end of the body for defining a central head portion and opposite arm portions of a puppet. The second end portion of the body defines an entrance opening therein for the hand of the user and is attached to the front panel of a torso worn garment in position thereon whereby a hand of the wearer of the garment may be inserted into the puppet for manipulation thereof toward his amusement or the amusement of others.

The main object of this invention is to provide a garment attached puppet toy for use by small children and which is attached to a torso worn garment in position thereon to be readily manipulated by a hand of the wearer of the garment.

Another object of this invention is to provide a puppet toy in accordance with the preceding object and operatively associated with a pocket of the associated garment.

Still another object of this invention is to provide a puppet toy which may be turned inside out inwardly of a pocket opening formed in the associated garment and utilized as a pocket for the garment.

A further object of this invention is to provide a puppet toy which may be readily folded and stored in a compact state within an existing pocket provided on a torso worn garment.

Still another object of this invention is to provide a puppet toy which may be stored in a position completely out of view from the exterior of the associated garment.

A final object of this invention to be specifically enumerated herein is to provide a puppet toy in accordance with the preceding objects and which will comform to conventional forms of manufacture, be of simple construction and readily adaptable in various manners to different types of torso worn garments.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is an enlarged fragmentary horizontal sectional view taken substantially upon the plane indicated by the section line 4—4 of FIG. 1;

FIG. 5 is a fragmentary perspective view of a second form of puppet toy mounted in operative association with a garment pocket;

FIG. 6 is an enlarge fragmentary vertical sectional view taken substantially upon the plane indicated by the section line 6—6 of FIG. 5;

FIG. 7 is an enlarged fragmentary vertical sectional view similar to FIG. 6 but illustrating a third form of hand puppet toy; and FIG. 8 is an exploded perspective view of the various components which are utilized to construct and mount the puppet toy illustrated in FIGS. 1-4.

DETAILED DESCRIPTION OF THE INVENTION

Figure 1:
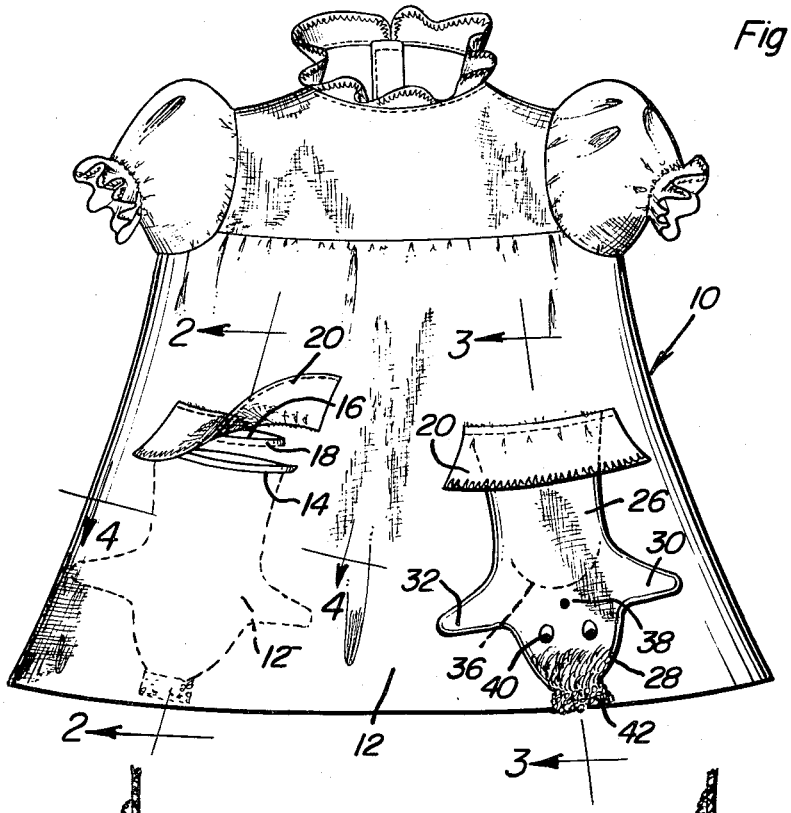
FIG. 1 is a front elevational view of a garment to be worn on the torso of a small child and with exposed and stored hand puppet toys of the instant invention supported from the front panel of the garment.

Referring now more specifically to FIGS. 1-4 of the drawings it will be seen a child's garment referred to in general by the reference numeral 10 and which is in the form of a dress. The dress 10 includes a front panel 12 having a horizontal pocket opening 14 formed therein. In addition, an operating slot opening 16 is formed in the panel 12 closely above the pocket opening 14 and is reinforced by means of a peripheral bead 18. Further, the pocket opening 14 is provided with a cover flap 20 which is secured to the front panel 12 as at 22 above the operating slot opening 16, the lower marginal edge of the cover flap 20 extending downwardly below the level of the pocket opening 14.

Figure 2:
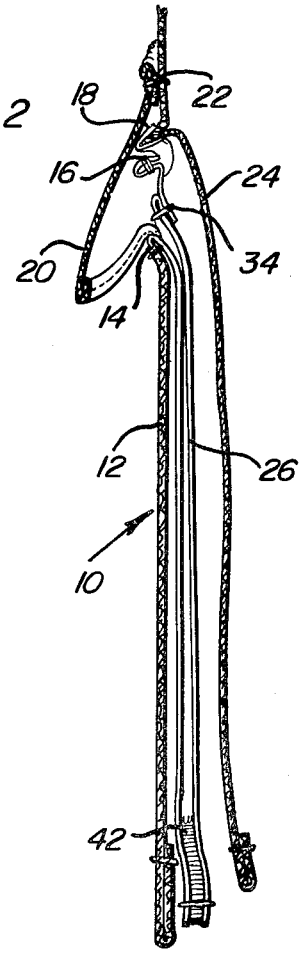
FIG. 2 is an enlarged fragmentary vertical sectional view taken substantially upon the plane indicated by the section line 2—2 of FIG. 1.
Figure 3:
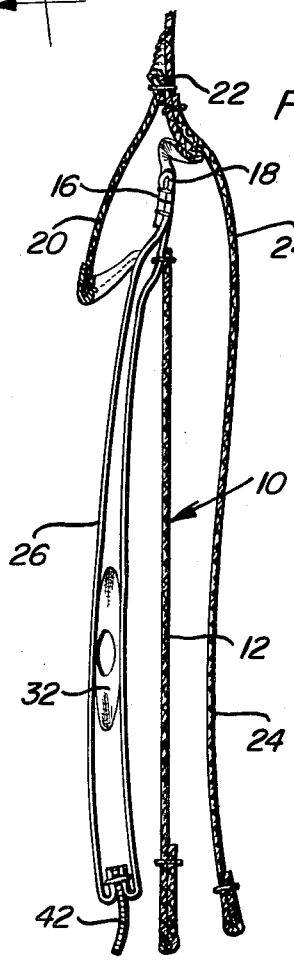
FIG. 3 is an enlarged fragmentary vertical sectional view taken substantially upon the plane indicated by the section line 3—3 of FIG. 1.

It may be seen from FIGS. 2 and 3 of the drawings that a backing flap 22 is secured to that portion of the front panel 12 defining the upper marginal portion of the operating slot openings 16 and hangs downwardly along the inner surface of the front panel 12 of the garment 10. Further, an elongated tubular body constructed of flexible material is provided and includes a central inwardly opening head defining cavity portion 28 and a pair of opposite side arm defining cavity portions 30 and 32 at one closed end of the body 26. The other end portion of the body 26 is open and is secured about the portions of the front panel 12 defining the pocket opening 14 as at 34.

In FIG. 2 of the drawings, the body 26 is disposed in wrong-side-out condition and is displaced inwardly of the pocket opening 14 and thereby defines a pocket for the front panel 12 of the garment 10. The entrance of the pocket defined in FIG. 2 by the wrong-side-out body 26 is covered by the cover flap 20.

With attention now invited to FIG. 3, it may be seen that the body 26 is disposed outwardly of the opening 14 in right-side-out condition and from FIG. 1 of the drawings, it may be seen that the front side of the body 26 has markings 36, 38, 40 and 42 thereon designating mouth, nose, eye and hair portions, respectively, of the hand puppet defined by the body 20. In operation, when the wearer of the garment 10 desires to use the puppet, the body 26 is withdrawn from the pocket opening 14 so as to be disposed in the manner illustrated in FIGS. 1 and 3 of the drawings. Then, the wearer of the garment 10 lifts the cover flap 20 and inserts her hand inwardly through the operating slot openings 16 and outwardly through the pocket opening 14 into the open end of the body 26. Thereafter, the hand puppet defined by the body 26 may be readily manipulated in the desired manner, the backing flap 24 being provided for disposition between the body 26 when the latter is in the stored position thereof illustrated in FIG. 2 of the drawings and the wearer of the garment 10.

With attention invited now more specifically to FIGS. 5 and 6 of the drawings, there will be seen a second form of garment referred to in general by the reference numeral 10' and including a pocket patch 19 secured thereon including a flap 20' similar to the flap 20 but of a decorative nature. A tubular body 26' corresponding to the body 26 is secured at its end remote from the head defining cavity portion 28' corresponding to the portion 28 to the inner side of the upper marginal edge of the pocket patch 19. However, the back side 29 of the body 26' has an operating opening 16' formed therein through which the hand of the wearer of the garment 10' may insert her hand into the body 26' when the latter has been withdrawn from the pocket and unfolded. The opening 16' may be formed in either the front or rear side of the body 26'. The end of the body remote from the head defining cavity portion 28 is closed and sewn to the upper marginal edge portion of the pocket patch 19 as at 34' and the upper marginal edge of the pocket patch 19 includes a decorative flap 20'.

With attention now invited more specifically to FIG. 7 of the drawings, there may be seen a third form of body designated by the reference numeral 26'' and which is mounted on a garment 10'' similar to the garment 10, but which includes a cover flap 20'' corresponding to the flap 20. Further, the end of the body 26'' having an opening 16'' formed therein corresponding to the opening 16 is closed and sewn to the front panel 12'' of the garment 10'' as at 34''. Of course, the body 26'' may be folded and stored within the pocket defined by the pocket patch 19' corresponding to the patch 19 and withdrawn from the pocket and beneath the cover flap 20'' at any time the wearer of the garment 10'' desired to use the hand puppet defined by the body 26''.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a garment including a front panel having inner and outer sides, a puppet toy comprising an elongated tubular puppet body constructed of flexible material and including three inwardly opening hollow fingerstall portions at one closed end portion of said body defining a central head portion and opposite side arm portions, the other end portion of said body defining a hand entrance opening therein for the reception of a hand into said tubular body from said other end portion thereof, said front panel including a pocket opening formed therein, said hand entrance opening being secured to said front panel about said pocket opening, said body being receivable, in inside-out condition on the inner side of said front panel to define a pocket into which said pocket opening opens and being displaceable outwardly of said pocket opening on the outer side of said front panel is outside-out condition to define said puppet toy, said front panel having an access opening therein closely adjacent said pocket opening adapted to receive a user's hand and wrist therethrough from the outer side of said front panel for manipulation of said puppet from the inner side of said front panel.

2. The combination of claim 1 wherein said access opening is disposed closely above said pocket opening.

3. The combination of claim 2 including a pocket flap secured to the outer side of said front panel overlying said access and pocket openings.

* * * * *